US006109153A

United States Patent [19]

Dueck

[11] Patent Number: 6,109,153

[45] Date of Patent: Aug. 29, 2000

[54] WIRE DRIVEN CUTTER FOR CARPET DISPENSER

[76] Inventor: Raymond Dueck, Box 700, Arborg, Canada, R0C 0A0

[21] Appl. No.: 08/825,939

[22] Filed: Apr. 1, 1997

[51] Int. Cl.[7] ..... B26D 14/00

[52] U.S. Cl. ..... 83/487; 83/614; 83/DIG. 937

[58] Field of Search ..... 83/614, 613, 487, 83/488, 508, DIG. 936, DIG. 937–941

[56] References Cited

U.S. PATENT DOCUMENTS

| | | | |
|---|---|---|---|
| 3,977,286 | 8/1976 | Werner | 83/524 |
| 4,230,029 | 10/1980 | Schott, Jr. | 83/614 |
| 4,383,458 | 5/1983 | Kitai | 83/405 |
| 4,505,174 | 3/1985 | Carithers, Jr. | 83/614 |
| 4,506,575 | 3/1985 | McCay et al. | 83/614 |
| 4,779,500 | 10/1988 | Bennett et al. | 83/614 |
| 4,781,094 | 11/1988 | Moretti | 83/488 |
| 4,809,921 | 3/1989 | Dueck et al. . | |
| 5,168,786 | 12/1992 | Huggins et al. | 83/614 |
| 5,197,643 | 3/1993 | Augustin | 83/614 |
| 5,421,231 | 6/1995 | Break et al. | 83/614 |
| 5,431,077 | 7/1995 | Murakami | 83/614 |
| 5,775,191 | 7/1998 | Burton et al. | 83/614 |

*Primary Examiner*—M. Rachuba
*Attorney, Agent, or Firm*—Adrian D. Battison; Murray E. Thrift

[57] ABSTRACT

The cutting mechanism includes a cutter block mounting a knife blade arranged for movement along a slot in a cutting table. The cutter block is driven by a cable and a first drive pulley. The cable extends under and around the first drive pulley and a second pulley, with the first end of the cable fixed to a second end of the cutter block, and the second end of the cable fixed to a first end of the cutter block. The cable and the first and second pulleys are arranged such that when the cutter block lies between the first end of the slot in the table and a center of first drive pulley the first and second ends of the cable are drawn taut thereby stopping movement of the cutter block along the slot towards the first end, and such that when the cutter block lies between the second end of the slot in the table and a center of the second pulley the first and second ends of the cable are likewise drawn taut stopping movement of the cutter block along the slot towards the second end. The cutting mechanism also includes a slot and receptacle arranged to mount the knife blade on the cutter block such that the knife blade can easily be arranged within, and removed from the slot and the receptacle. The cutter block also includes a knife blade securing means positionable between a first position which secures the knife blade in the slot, and a second position allowing for removal of the knife blade. Notches are provided at the top end of the slot which allow for easy grasping of the knife blade when removing the knife blade from the slot and allow for easy insertion of the knife blade into the slot. The notches are sized such that the finger and thumb of a person can easily grasp the second end of the knife blade.

11 Claims, 5 Drawing Sheets

WIRE DRIVEN CUTTER FOR CARPET DISPENSER

FIELD OF THE INVENTION

The present invention relates to cutting mechanisms for cutting floor covering materials, particularly of the type for use with a rolled supply of floor covering material.

BACKGROUND

Devices used for cutting carpet, vinyl flooring, and other floor covering materials are known. These devices can be as simple as a rack for supporting a roll of floor covering material adjacent a cutting surface such as a floor or table top. The floor covering material is dispensed from the rack onto the cutting surface and is cut by an individual with a knife. After cutting the floor covering material is manually rerolled. One disadvantage of this method is that large areas are required to lay out the floor covering material during cutting. A second disadvantage is that if the floor covering material is cut on a floor the floor covering material can be damaged by contact with materials on the floor.

More complex apparatus for performing this task are also known. One example of which includes a cradle or rack for supporting the roll of floor covering material to be dispensed, a table top across which the floor covering material is drawn, and a means of automatically rerolling the floor covering material arranged opposite the roll. These components are generally mounted on a frame to keep them raised above the floor at an appropriate height for working. The table top includes a slot running laterally across the table through which a knife blade of a cutter projects. The knife blade and cutter are propelled along the slot by a mechanism which may include a chain which is driven by a sprocket arrangement or a cutter block driven by an air or hydraulic cylinder. When the cutter reaches either of the ends of the slot it contacts a stop which prevents further movement along the slot.

Devices of this type using a chain driven mechanism have the problem that they often cut in only one direction, while hydraulic and air driven systems are expensive and costly to maintain. These systems also tend to be excessively noisy. This is caused in part by the impact of the cutter on the stop.

A further problem of existing cutting mechanisms is that the knife blades are often bolted or otherwise fixed to the cutting block or chain making removal and replacement of the knife blade time consuming and difficult.

One prior cutting mechanism used with a device of the type described above includes a runner for traveling along a slot in the table. The runner has a wheeled member arranged below the table top and aligned with the slot, a standard is fixed to the top of the wheeled member and extends through the slot. A roller mounting member is fixed to the top of the standard, and rollers are mounted on the standard to hold the carpet in place on the table top during cutting. The rollers are biased downwards towards the table by biasing means fixed to the top of the standard. A pair of opposed knife blades are bolted to the wheeled member below the surface of the table and extend up through the slot to a top end. The top end of the each knife blade lies in a depression in a side of the roller mounting member.

This arrangement is unnecessarily complex making it expensive and makes removal and replacement of the knife blades difficult since the runner must be removed from the machine before operator can remove the bolts to release the blades.

SUMMARY

According to the present invention there is provided a cutting mechanism for cutting a length of floor covering material from a supply of floor covering material, said cutting mechanism comprising:

- an elongate member having a first end, a second end, an outer face for receiving the floor covering material thereon, and an inner face opposite the outer face;
- a slot in the elongate member extending from the first end to the second end thereof;
- a cutter block having a first end and a second end and being arranged for movement along the slot between the first and second ends of the slot;
- a knife blade mounted on the cutter block and extending through the slot to the second end;
- a cable having a first end and a second end, said cable being fixed at each of its first and second ends to the cutter block;
- and drive means for selectively moving the cable in one of a first direction thereby causing movement the cutter block along the slot towards the first end of the slot, and a second direction thereby causing movement of the cutter block along the slot towards the second end of the slot.

Preferably the cutting mechanism includes a first pulley arranged to lie at a position spaced from the first end of the elongate member in the direction towards the second end of the elongate member and spaced from the inner surface of the elongate member and from the cutter block. A second pulley is arranged to lie at a position spaced from the second end of the elongate member in the direction towards the first end of the elongate member and spaced from the inner surface of the elongate member and from the cutter block and drive means are arranged to selectively rotate one of the first and second pulleys in one of a first rotational direction and a second rotational direction. The cable is arranged to extend under and around each of the first and second pulleys, with the first end of the cable extending around the first pulley to the second end of the cutter block, and the second end of the cable extending around the second pulley to the first end of the cutter block. The first end of the cable is fixed to the second end of the cutter block and the second end of the cable is fixed to the first end of the cutter block. Rotating one of the first and second pulleys in the first rotational direction draws the first end of the cable taut thereby drawing the cutter block along the slot in the first direction towards the first end of the slot. Rotating one of the first and second pulleys in the second rotational direction draws the second end of the cable taut thereby drawing the cutter block along the slot in the second direction towards the second end of the slot.

Preferably the cable and the first and second pulleys are arranged such that when the first end of cutter block lies between the first end of the slot and a center of the first pulley the first and second ends of the cable are drawn taut thereby stopping movement of the cutter block along the slot towards the first end, and such that when the second end of the cutter block lies between the second end of the slot and a center of the second pulley the first and second ends of the cable are drawn taut thereby stopping movement of the cutter block along the slot towards the second end.

Preferably the cutting mechanism includes a first idler pulley arranged to lie at a position adjacent the first pulley and between the first and second pulleys, and a second idler pulley arranged to lie at a position adjacent the second pulley and between the first and second pulleys, and wherein the cable is arranged to extend over the first and second idler pulleys and then under and around each of the first and second pulleys.

According to a second aspect of the present invention there is provided a cutting mechanism for cutting a length of floor covering material from a supply of floor covering material, said cutting mechanism comprising:

an elongate member having a first end, a second end, an outer face for receiving the floor covering material thereon, and an inner face opposite the outer face;

a slot in the elongate member extending from the first end to the second end thereof;

a cutter block having a first end and a second end and being arranged for movement along the slot between the first and second ends of the slot;

a knife blade mounted on the cutter block and having a first end and a second end arranged such that the first end lies adjacent the cutter block and extends through the slot to the second end;

at least one pair of rollers rotatably mounted on the cutter block adjacent the second end of the knife blade, such that the rollers are arranged adjacent the outer face of the elongate member to engage a portion of the floor covering material thereby holding the floor covering material in place against the outer face of the elongate member for cutting;

drive means for moving the cutter block along the slot between the first and second ends of the slot;

and biasing means arranged within the cutter block for biasing the rollers towards the outer face of the elongate member.

According to a third aspect of the present invention there is provided a cutting mechanism for cutting a length of floor covering material from a supply of floor covering material, said cutting mechanism comprising:

an elongate member having a first end, a second end, an outer face for receiving the floor covering material thereon, and an inner face opposite the outer face;

a slot in the elongate member extending from the first end to the second end thereof;

a cutter block having a first end and a second end and being arranged for movement along the slot between the first and second ends of the slot;

drive means for moving the cutter block along the slot between the first and second ends of the slot;

a knife blade mounted on the cutter block and having a first end and a second end and being arranged such that the first end lies adjacent the cutter block and such that the knife blade extends through the slot to the second end;

connection means having a first end and a second end, said connection means being fixed to the cutter block at the first end and extending through the slot to the second end;

a knife blade mounting member fixed to the second end of the connection means, said knife blade mounting member extending longitudinally along the cutter block;

a receptacle fixed to the cutter block adjacent the connection means between the connection means and one of the first and second ends of the cutter block;

a slot in the knife blade mounting member aligned with the receptacle for receiving the knife blade therethrough, said slot extending through the knife blade mounting member adjacent the connection means between the connection means and said one of the first and second ends of the cutter block;

and wherein the slot in knife blade mounting member and receptacle are arranged such that the knife blade can be removably arranged within the slot and receptacle with the first end of the knife blade being arranged within the receptacle and the second end of the knife blade being arranged within said slot.

Preferably the cutter block includes a knife blade securing means. The knife blade securing means comprises a securing member having a first end pivotally fixed to the knife blade mounting member adjacent a first end thereof, a free second end arranged adjacent a second end of the knife blade mounting member and a contact surface arranged to extend across the slot or slots in the knife blade mounting member. A catch means is fixed to the knife blade mounting member adjacent the second end thereof for releasably engaging the securing member adjacent the second end. The securing member is positionable in a first position such that the catch means engages the securing member holding it in place, and such that the contact surface extends across the slot and contacts the second end of the knife blade securing it in the slot. The securing member is also positionable in a second position such that the securing member is free from the catch means, and such that the contact surface is spaced from the slot and the second end of the knife blade providing for removal of the knife blade.

Preferably the cutter block includes semi-circular notches arranged at the slot adjacent the securing member. The semi-circular notches allow for easy grasping of the knife blade when removing the knife blade from the slot and allow for easy insertion of the knife blade into the slot. The semi circular notches are sized such that the finger and thumb of a person can easily grasp the second end of the knife blade.

BRIEF DESCRIPTION OF THE DRAWINGS

In the accompanying drawings, which illustrate an exemplary embodiment of the present invention.

DETAILED DESCRIPTION

Figure 1:
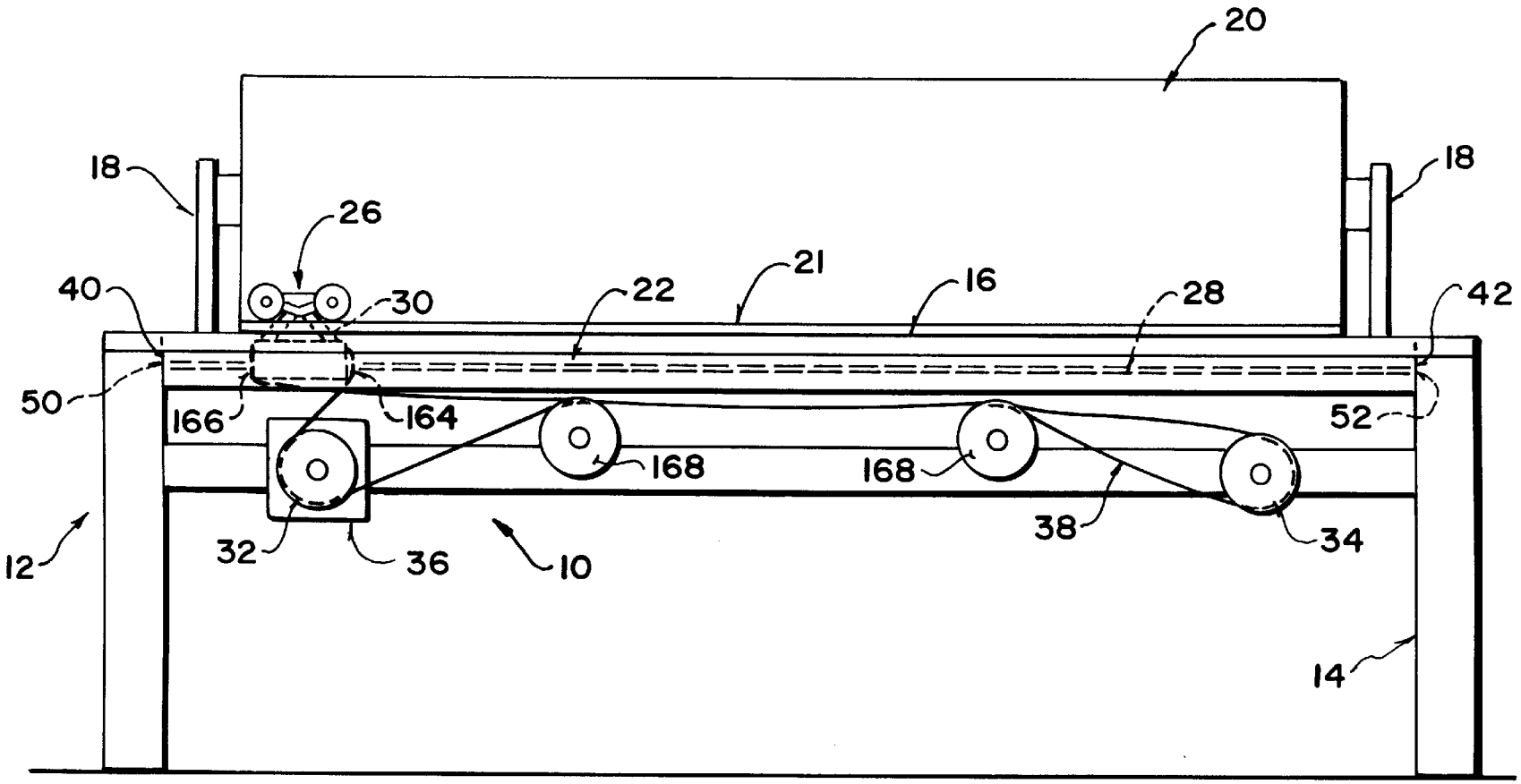
FIG. 1 is a front view of a floor covering material dispenser mounting the cutting mechanism.
Figure 2:
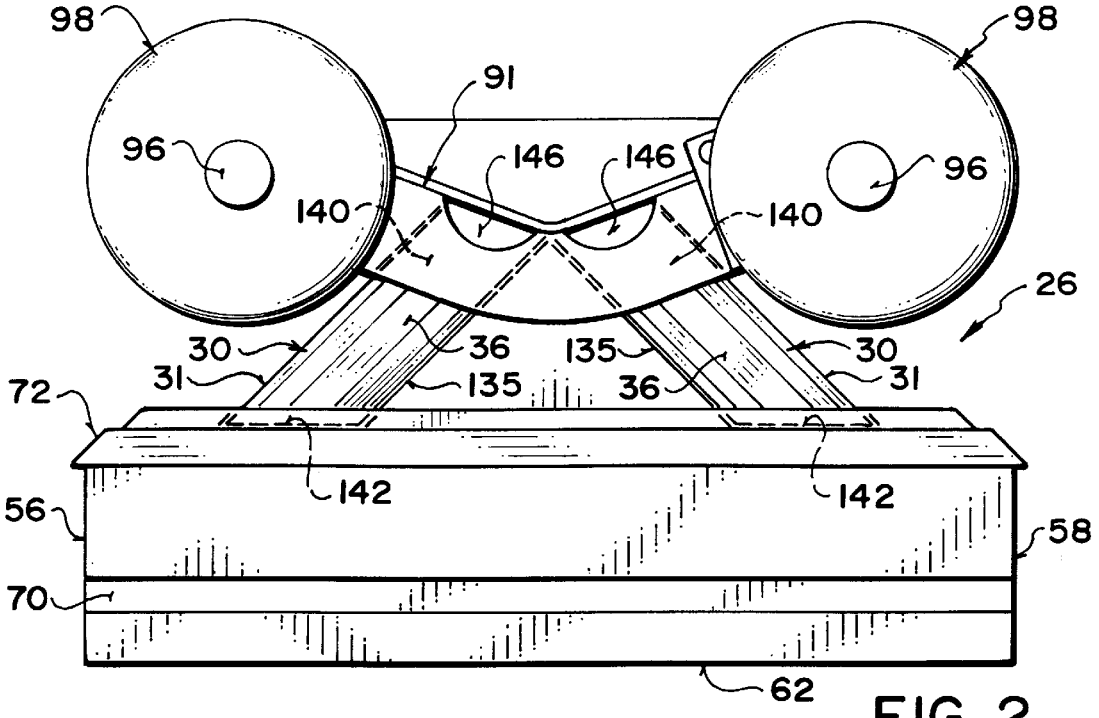
FIG. 2 is a front view of the cutter block.

Referring to FIGS. 1 to 4 the cutting mechanism is shown generally at 10. The cutting mechanism 10 is mounted on a dispensing and cutting apparatus 12 for floor covering material. The dispensing and cutting apparatus 12 includes a frame 14 for supporting a table top 16 and means 18 for supporting a roll 20 of floor covering material. The roll 20 is supported such that a portion of the floor covering material 21 can be drawn across the table top 16 for cutting. The cutting mechanism 10 is mounted on the frame 14 below the table top 16 and includes a knife blade 30 which extends upwards through the table top 16 for cutting the floor covering material 21.

The cutting mechanism 10 comprises an elongate member 22, a slot 24, a cutter block 26, cutter block guide means 28, a pair of knife blades 30, a first drive pulley 32, a second drive pulley 34, drive means 36, and a cable 38.

Figure 3:
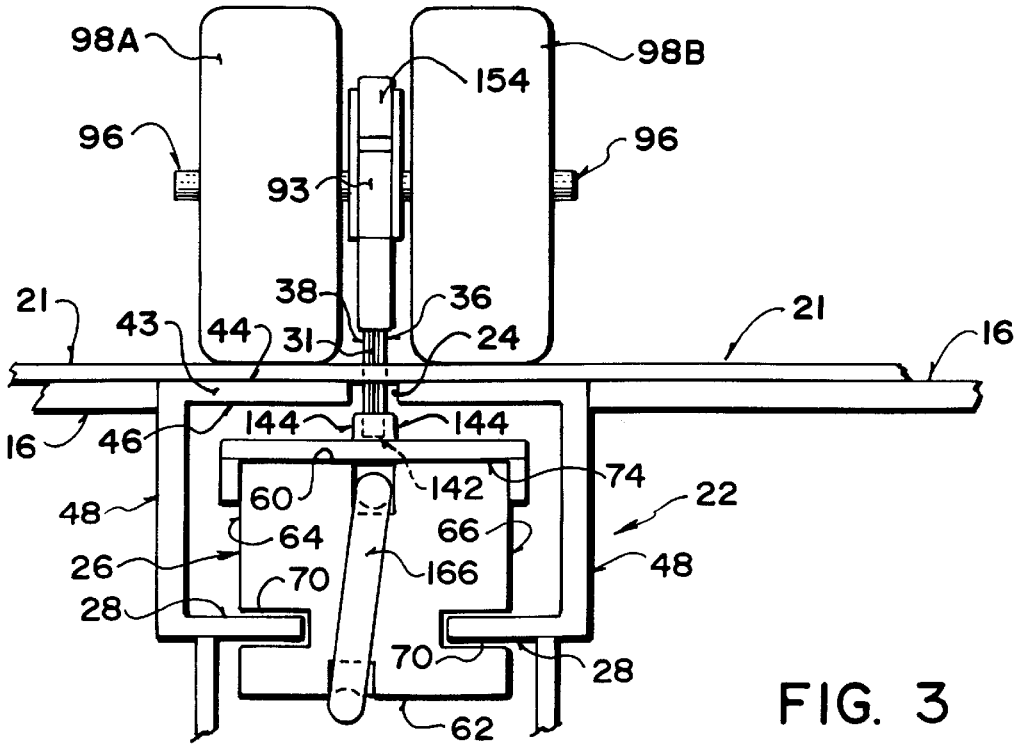
FIG. 3 is a side view of the cutter block in place in the guide means on the elongate member.

Referring to FIGS. 1 and 3 the elongate member 22 is arranged in the table top 16 and extends laterally across the table top 16 from a first end 40 to a second end 42. The elongate member 22 includes a top wall 43 having an outer face 44 which lies substantially coplanar with the table top 16 and receives the floor covering material 21 for cutting, and an inner face 46 opposite the outer face 44. The slot 24 extends along the elongate member 22 from the first end 40 to the second end 42 thereof. The slot 24 provides an opening for the knife blade 30 to extend through, and run along, while cutting the floor covering material 21. The elongate member 22 also includes a pair of side walls 48 each of which extends downwards from the inner face 46 and is arranged to run along the elongate member 22 from the first end 40 to the second end 42 parallel to the slot 24.

The cutter block guide means 28 comprise a pair of opposed flanges, one arranged along each of the side walls 48 of the elongate member 22. The opposed flanges 28 are aligned with one another and extend inwards from the side walls 48 towards one another. The cutter block guide means 28 are spaced downwards from the inner face 46 and extend parallel to the slot 24 and have a first end 50 arranged adjacent the first end 40 of the elongate member 22 and a second end 52 arranged adjacent the second end 42 of the elongate member 22.

Referring to FIGS. 2, 3, 5 and 7 the cutter block 26 comprises a substantially rectangular block and extends from a first end 56 to a second end 58. The first end 56 is arranged to lie nearest the first end 40 of the elongate member 22 and the second end 58 is arranged to lie nearest the second end 42 of the elongate member 22. The cutter block 26 also includes a top side 60, a bottom side 62, a first side 64, and a second side 66. The cutter block 26 is arranged between the side walls 48 of the elongate member 22 with the top wall 60 arranged to lie adjacent the inner face 46 of the elongate member 22. The first and second sides 64 and 66 are opposed to each other and lie adjacent respective side walls 48 of the elongate member 22. Each side wall 64 and 66 includes a groove 70 extending longitudinally along the cutting block 28 from the first end 56 to the second end 58. Each groove 70 is arranged to slidably receive a respective one of the pair of flanges 28 such that the cutter block 26 is arranged on the guide means 28 for movement along the length of the slot 24.

Referring to FIGS. 2 to 7 the cutting block 26 also includes a plate member 72 aligned with the cutting block 26 and arranged to lie along the top side 60 of the cutting block 26 between the cutting block 26 and the inner face 46 of the elongate member 22. The plate member 72 includes a first face 74 arranged to lie adjacent the cutter block 26 and a second face 76 arranged to lie adjacent the inner face 46 of the elongate member 22. The plate member 72 also includes an alignment pin 78 which projects downward from the first face 74 and is received within a hole 80 within the cutting block 26. The alignment pin 78 keeps the plate member 72 correctly aligned and in place on top of the cutting block 26. The plate member 72 also includes side flanges 82 extending downwardly from the plate member 72 and over a portion of the sides 64 and 66 of the cutting block 26. The flanges 82 extend along the length of the plate member 72 and help align the plate member 72 on the cutting block 26.

An upright standard 84 is fixed to the plate member 72 and is arranged to lie on a longitudinal center line 86 of the cutter block 26. The standard 84 is triangular and extends upwards from a first end 88 to a second end 90. The standard 84 is arranged to extend through the slot 24 with the second end 90 spaced upwards from the outer face 44 of the elongate member 22 and from the table top 16. The first end 88 provides the base of the triangle and the second end 90 is the apex of the triangle.

A roller mounting member 91 is provided by a pair of arms 92 and 94 extending outwards from the standard 84 and longitudinally along the cutting block 26 to ends 93 and 95. The arms 92 and 94 extend in opposite directions and mount at least one pair of rollers 98 thereon. An axle member 96 extends laterally through each of the arms 92 and 94 adjacent the respective ends 93 and 95 and supports the rollers 98. The arms 92 and 94 are arranged to extend outwards from the standard 84 such that the arm 92 extends towards the first end 56 of the cutter block 26 and upwards and away from the cutting plate member 72 to the end 93. The arm 94 likewise extends outwards from the standard 84 towards the second end 58 of the cutting block 26 and upwards and away from the plate member 72 to the end 95. In the embodiment illustrated two pairs of rollers 98 are employed one being mounted on each of the arms 92 and 94.

The rollers 98 are arranged towards the respective ends 56 and 58 of the cutting block 26 such that the rollers 98 engage the floor covering material 21 to be cut. The rollers 98 lie to either side of each knife blade 30 adjacent a leading edge 31 of the knife blade 30 and hold the floor covering material 21 securely in place against the elongate member 22 during cutting to ensure a good cut. The rollers 98 are rotatably mounted on the axles 96 for travel across the elongate member 22 and are arranged such that a first one 98A of each pair of rollers lies adjacent a first side 36 of the knife blade 30 and a second one 98B of the rollers 98 lies adjacent the second side 38 of the knife blade 30. This holds the floor covering material 21 in place on either side of the knife blade 30 and further aids in ensuring a good cut.

Figure 6:
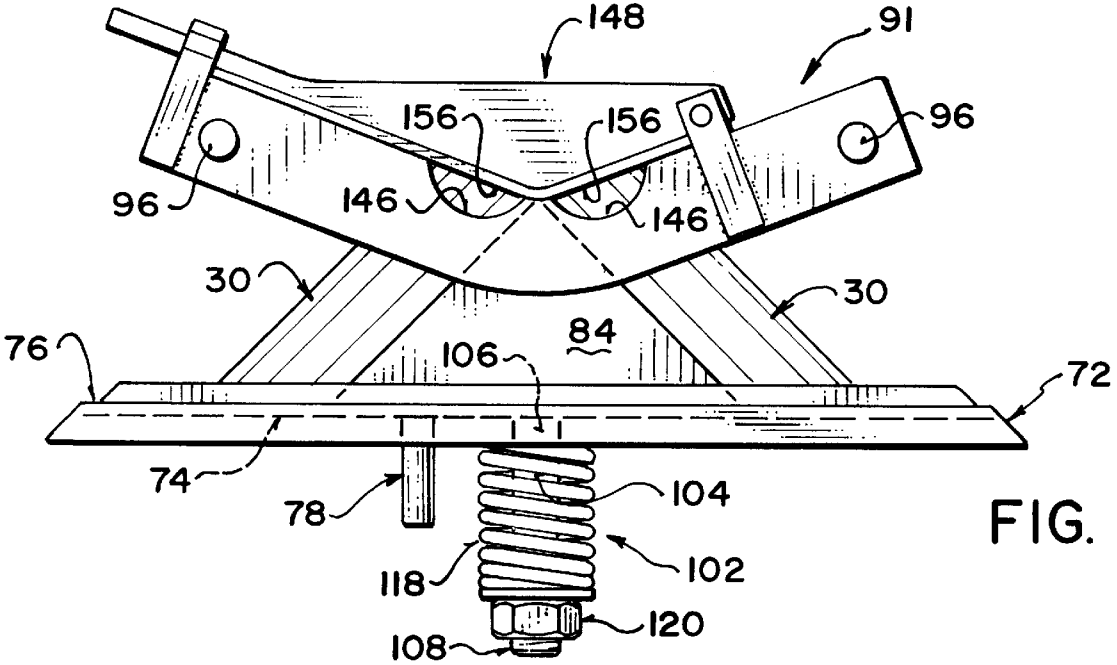
FIG. 6 is a front view of the roller mounting member, the plate member, and the biasing means.
Figure 7:
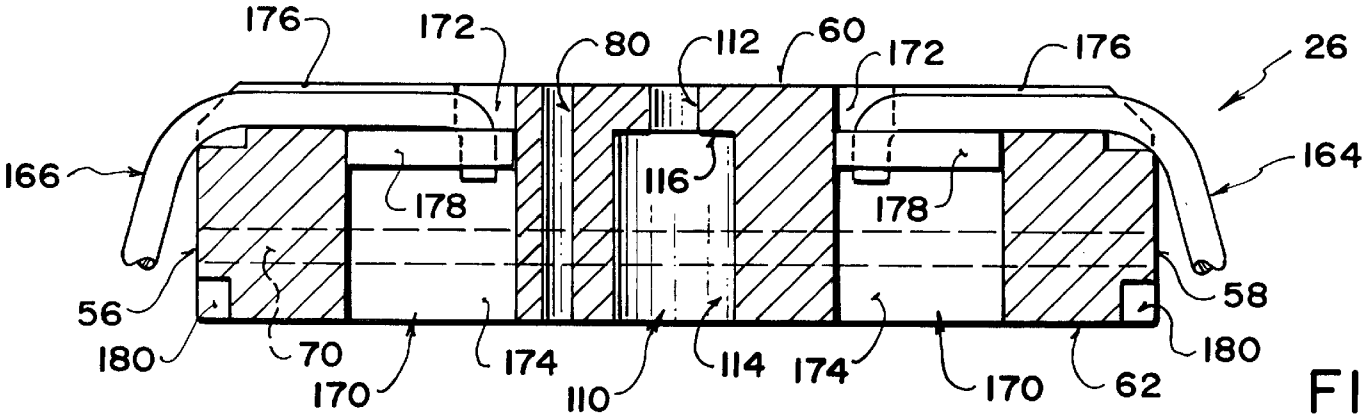
FIG. 7 is a cross sectional view of the cutter block.

Referring to FIGS. 6 and 7, biasing means 102 are provided for biasing the rollers 98 towards the outer face 44 of the elongate member 22. The biasing means 102 comprise an elongate compression member 104 which extends downwards from the first face 74 of the plate member 72. The elongate compression member 104 extends from a first end 106 fixed to the first face 74 to a free second end 108. The elongate compression member 104 is arranged to extend through a hole 110 extending through the cutter block 26 from the top side 60 through to the bottom side 62. The hole 110 is arranged to receive the elongate compression member 104 therein and includes a narrow portion 112 adjacent the top side 60 of the cutter block 26 and wider portion 114 at the bottom 62 of the cutter block 26. At the transition from the narrow portion 112 to the wider portion 114 a shoulder 116 is formed. A resilient means 118 usually a coil spring is arranged within the wider portion 114 of the hole 110 and around the compression member 106 between the first and second ends 106 and 108 thereof. The top of the coil spring 118 lies in contact with the shoulder 116 at its top end. The bottom end of the coil spring 118 is held in place on the elongate compression member 104 by a fastener 120 arranged at the free end 108 of the elongate compression member 104. The fastener is typically a nut turned onto a thread on the compression member 104. The coil spring 118 is thus held between the shoulder 116 and the fastener 120 such that movement of the elongate compression member 104 within the hole 110 in an upwards direction causes compression of the spring 118.

The biasing means 102 bias the rollers 98 such that movement of the rollers 98 in a direction away from the outer face 44 of the elongate member 22 causes the plate member 72 to move upwards towards the inner face 46 of the elongate member 22 and in turn causes movement of the free end 108 of the compression member 104 upwards towards the shoulder 116. This compresses the spring 118 thereby developing a downwards biasing force which is applied to the rollers 98 through the compression member 104 biasing the rollers 98 back towards the outer face 44 of the elongate member 22.

Referring to FIGS. 2 to 5 the pair of knife blades 30 are mounted on the cutting block 26 and extend upwards from the cutting block 26 through the slot 24. In the embodiment illustrated the pair of knife blades 30 are opposed for cutting floor covering material 21 in either direction along the slot 24. Each knife blade 30 has a first end 130 and a second end 132 and is mounted on the cutter block 26 at the first end 130 extending upwards through the slot 24 to the second end 132. Each knife blade 30 has a cutting edge along a leading edge 31 thereof and sides 36 and 38 arranged laterally of the cutting edge 31.

The cutting block 36 includes a slot 140 extending through a knife blade mounting member which may be is provided by the arms 92 and 94 of the roller mounting member 91 or may be an additional arm or pair of arms. A receptacle 142 is fixed to the plate member 72. The receptacle 142 is fixed to the second face 76 of the plate member 72 and is arranged adjacent the standard 84 between the standard 84 and one of the first and second ends 56 and 58 of the cutter block 26. The receptacle 142 comprises a pair of upwardly extending flanges 144 which are spaced apart and arranged to extend along the longitudinal center line 86 through the cutter block 26. The upwardly extending flanges 144 are closed adjacent the end of the cutting block 26.

Each slot 140 is aligned with a receptacle 142 for receiving the knife blade 30 and extends through a respective arm 94 and 96 at a location adjacent the standard 84 between the standard 84 and one of the first and second ends 56 and 58 of the cutter block 26. The slot 140 and the receptacle 142 are arranged such that the knife blade 30 can be removably arranged within the slot 140 and the receptacle 142 such that the first end 130 of the knife blade 30 is arranged within the receptacle 142 and the second end 132 of the knife blade 30 is arranged within the slot 140. The leading edge 31 of each knife blade 30 faces the end 56 or 58 of the cutting block 26 and the edge 135 opposite the leading edge 31 lies in contact with the standard 84. Since the standard 84 is triangular the leading edge 31 of the knife blade 30 lies at an angle to the plate member 72. Having the knife blade 30 set an angle improves the cutting efficiency over knife blades which are arranged in a vertical plane. The knife blade 30 is angled upwards and towards the standard from its first end 130 to its second end 132.

Each slot 140 includes a notch 146 arranged at its top end. The notch 146 allows for easy access to the knife blade 30 when removing or replacing the blade 30. The notch 146 is semi-circular in shape and is sized to accept the thumb and forefinger of a person.

Figure 4:
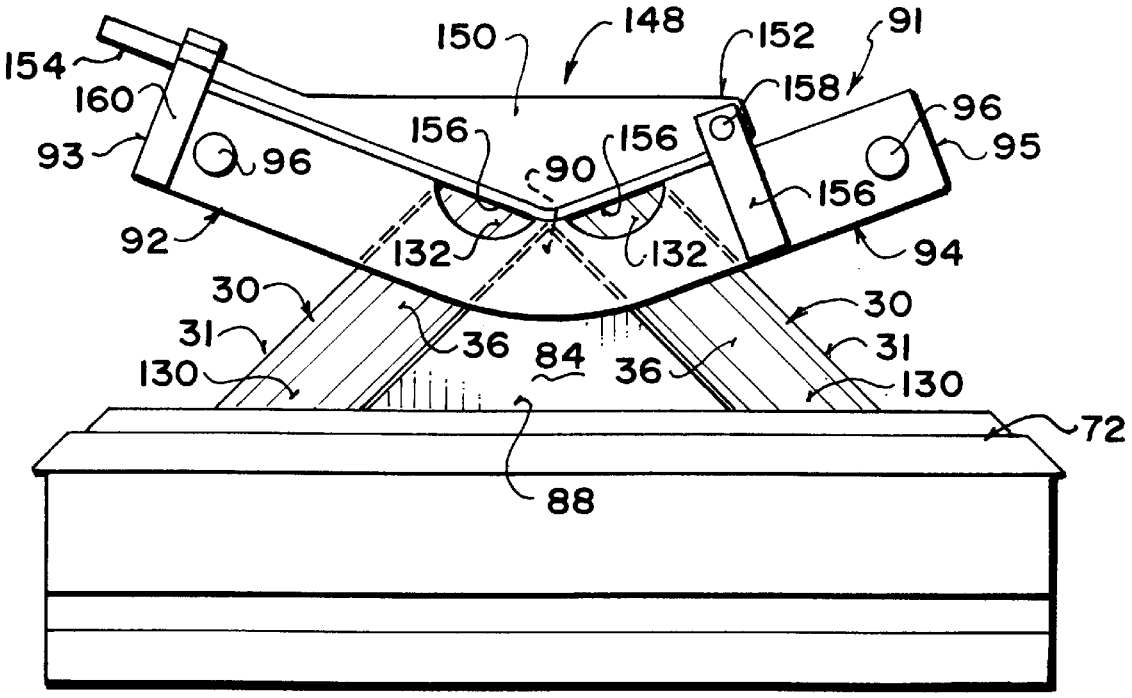
FIG. 4 is a front view of the cutter block without rollers.
Figure 5:
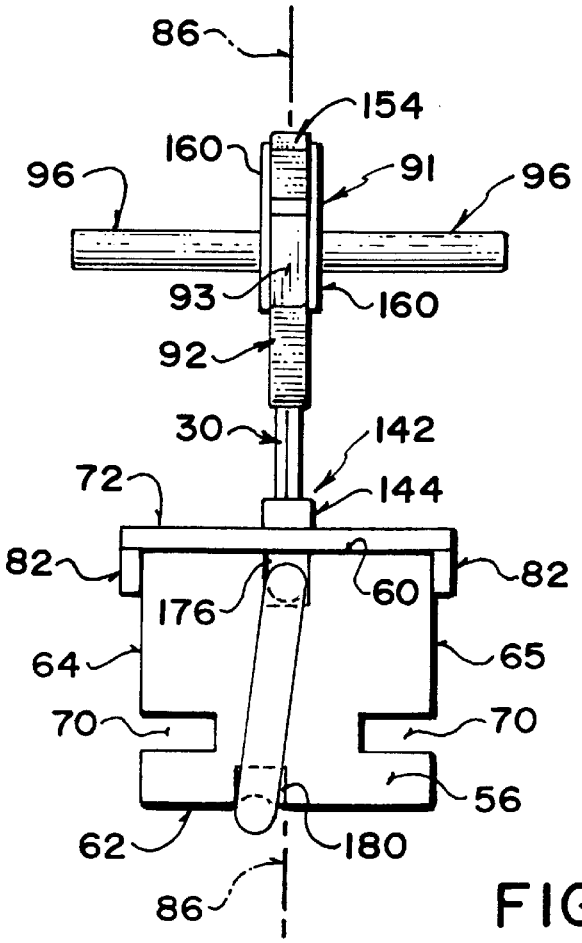
FIG. 5 is a side view of the cutter block without rollers.

Referring to FIG. 4 the cutter block 26 includes a knife blade securing means 148. The knife blade securing means 148 includes a securing member 150 which has a first end 152 pivotally fixed adjacent the end 95 of the arm 94. The securing member 150 extends from the first end 152 to a free second end 154 which is arranged to lie adjacent the end 93 of the arm 92 of the roller mounting means 91. The securing member 150 also includes a contact surface 156 which extends across each of the slots 140. The contact surface 156 is shaped to follow an upper surface of the arms 92 and 94. The securing member 150 is pivotally fixed at its first end 152 by a pivot connection comprising a pair of upwardly extending flanges 156 extending from either side of the arm 94 and a pin member 158 extending between the top ends of the flanges 156 and through a hole in the first end 152 of the securing member 150.

A catch means 160 is fixed adjacent the end 93 of the arm 92 of the roller mounting member 91 and is arranged to releasably engage the second end 154 of the securing member 150.

The securing member 150 is positionable between a first position and a second position. In the first position the catch means 160 engages the second end 154 of the securing member 150 holding the securing member 150 in place with the contact surface 156 extending across the slots 140 and in contact with the second end 132 of each of the knife blades 30. This secures each knife blade 30 within each respective slot 140 and receptacle 142.

In the second position the securing member 150 is free from the catch means 160 and the contact surface 156 is spaced from the slots 140 and the second end 132 of each of the knife blades 30. This allows for the easy removal and replacement of the each blade 30.

Figure 8:
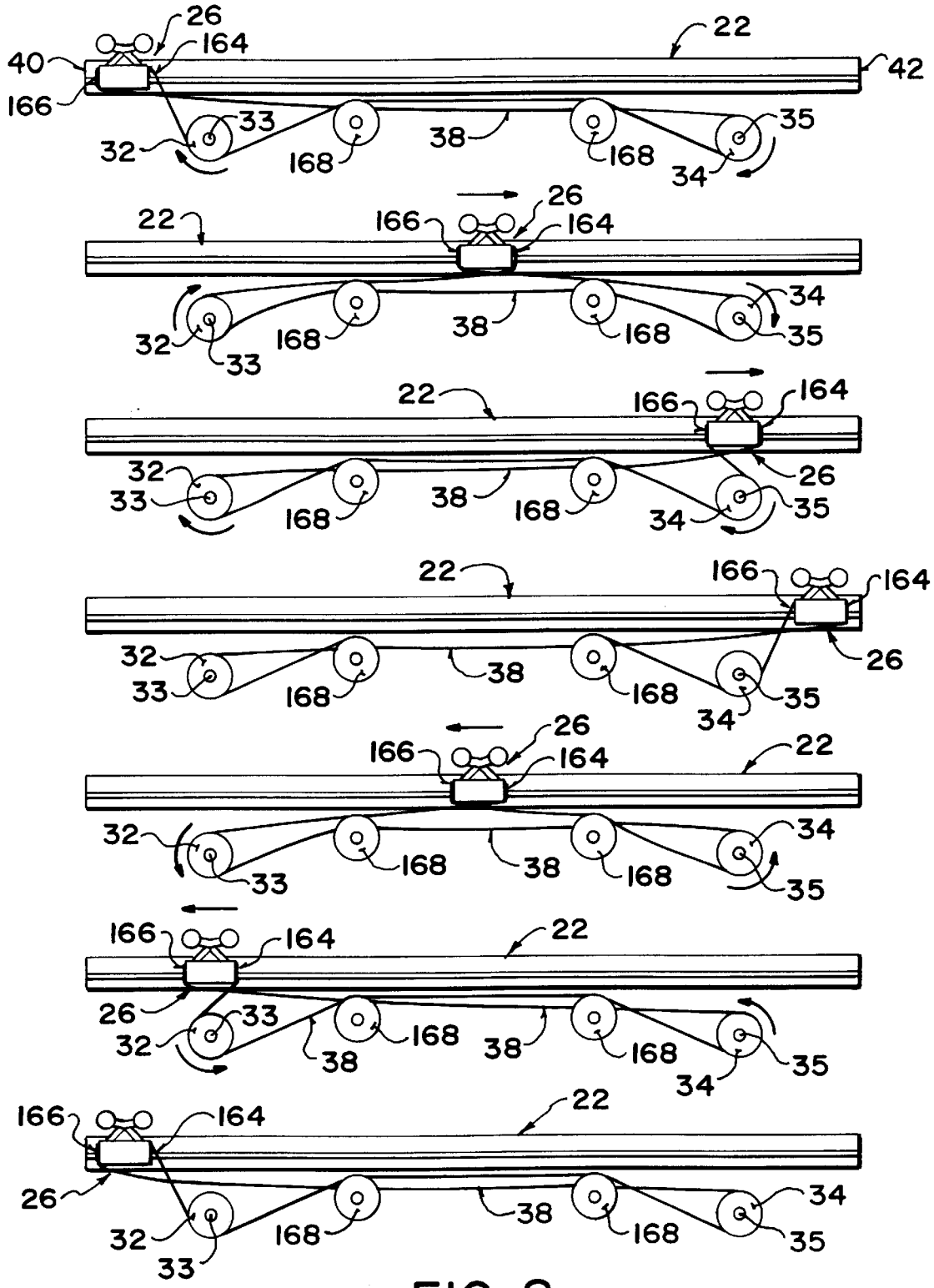
FIG. 8 is a schematic showing the movement of the cutter block and the action of the cable drive.

Referring to FIGS. 1 and 8 the cutting mechanism 10 also includes the first and second pulleys 32 and 34 and the cable 38 which moves the cutting block 26 along the length of the slot 24. The first and second pulleys 32 and 34 are arranged adjacent the ends 40 and 42 of the elongate member 22 and are arranged below the elongate member 22 and the cutting block 26. The first pulley 32 is a drive pulley and is arranged adjacent the first end 40 of the elongate member 22, spaced in from the first end 40 in the direction towards the second end 42. The second pulley 34 is arranged adjacent the second end 42 of the elongate member 22, spaced inwards from the second end 42 in a direction towards the first end 40. The first pulley 32 is driven by drive means 36 which selectively rotates the first pulley 32 in one of a first and second directions. The cutting mechanism 10 also includes a pair of idler pulleys 168 arranged between the first and second pulleys 32 and 34.

An cable 38 extends over the pulleys 32 and 34 and is connected to the cutting block 26. The cable 38 extends from a first end 164 to a second end 166 and is arranged to extend over the idler pulleys 68 and under and around each of the first and second pulleys 32 and 34. The first end 164 of the cable 38 extends around the first pulley 32 and across to the second end 58 of the cutter block 26. The second end 166 of the cable 38 extends around the second drive pulley 34 and across to the first end 56 of the cutting block 26. The first end 164 of the cable 38 is fixed to the second end 58 of the cutter block 26 and the second end 166 of the cable 38 is fixed to the first end 56 of the cutting block 26.

Rotating the first drive pulley 32 in a first direction draws the first end 164 of the cable 38 taut thereby drawing the cutting block 26 along the slot 24 towards the first end 40 of the slot 24.

Rotating the first drive pulleys 32 in a second direction draws the second end 166 of the cable 38 taut thereby drawing the cutting block 26 along the slot 24 towards the second end 42 of the slot.

The cable 38 and drive pulleys 32 and 34 are arranged such that the cutter block 26 can travel along the slot 24 towards the first end 40 of the slot 24 until the first end 56 of the cutting block 26 passes a center 33 of the first drive pulley 32. As the first end 56 of cutter block 26 passes the center 33 of the first drive pulley 32 the first and second ends 164 and 166 of the cable 38 are drawn taut stopping further movement of the cutter block 26 towards the first end 40 of the slot 24. Movement of the cutter block 26 along the slot 24 towards the second end 42 of the slot 24 is stopped in a similar manner when the cutter block 26 reaches a position where the second end 58 of the cutter block 26 passes a center 35 of the second pulley 34. Stopping the movement of the cutter block in this way eliminates the need for a stop and therefore eliminates any noise that would be caused by collisions between the cutter block and the stop.

Referring to FIG. 7 the first and second ends 164 and 166 of the cable 38 are fixed to the cutting block at the first and second ends 56 and 58 respectively. Each end 56 and 58 includes a hole 170 extending from the top 60 of the cutting block 26 to the bottom 62. Each hole 170 has a narrow portion 172 adjacent the top end 60 and a wider portion 174 adjacent the bottom end 62. A channel 176 extends into the block from each of the ends 56 and 58 along a longitudinal center line of the block 26. This channel 176 extends from each respective side 56 and 58 to the narrow portion 172 of the hole 170. Each of the first or second ends 164 or 166 of the cable 38 extends along a respective one of the channels 176 to a corresponding narrow portion 172 and then down into the wider portion 174 of the hole 170. A fastener 178 is connected to each end 164 and 166 of the cable 38. The fastener 178 is arranged within the wider portion 174 of the hole 170 and is arranged to be wider than the narrow portion 172 of the hole 170 thereby holding the cable 38 in place within the hole 170.

A cable alignment notch 180 is arranged on each end of 56 and 58 are the cutting block 26. The cable alignment notches 180 are arranged at the bottom 62 of each respective side 56 and 58 and are positioned to one side of the longitudinal center line 86 of the cutting block 26. The notches 180 on opposing ends 56 and 58 of the cutting block 26 lie to opposing sides of the longitudinal center line 86. The alignment notches 180 align the ends 164 and 166 of the cable 38 such that they will lie laterally of one another and thereby prevent the cable ends 164 and 166 from becoming entangled when the cutting mechanism 10 during in operation.

In use a cutting blade 30 is positioned in each slot 140 after moving the securing means 148 into the second position by lifting a second end 154 of the securing member 150 upwards. Each knife blade 30 is positioned in a slot 140 until the first end of the blade 30 is securely within the receptacle 142 and the second end 132 of the blade 30 lies in the slot 140. The securing means 148 are then moved into the first position such that the second end 152 is locked in place by the catch means 160 and the contact surface 156 engages the second end 132 of each knife blade 30. Floor covering material 21 is then rolled out over the table top 16 and across the cutting mechanism. The drive means 36 are now actuated rotating the first drive pulley 32 in the first direction and causing the first end 164 of the cable 38 to be drawn towards the first end 40 of the elongate member. Since the first end 164 of the cable 38 is fixed to the second end 58 of the cutting block 26 is draws the cutter block by the second end 58, and thus the knife blade 30, towards the first end 40 of the elongate member 22. As the cutting block 26 is drawn along the slot 24 the rollers 98 are in contact with the floor covering material 21 from above holding the floor covering material 21 in place on the table while the knife blade 30 cuts the carpet 21. As the cutting block 26 nears the end of the elongate member 22 a first end 56 of the cutting block 26 passes a center of the first drive pulley 32 drawing the first and second ends 164 and 166 of the cable 38 taut. This stops the cutter block 26 and leaves cutter block 26 in a position to begin cutting in the opposite direction. More floor covering material 21 may now be dispensed across the table 16 and the cutting mechanism 10 may be operated in the opposite direction by actuating the drive means 36 such that the first drive pulley 32 is rotated in the second direction. This causes the cutting block 26 to move along the elongate slot 24 from the second end 42 towards the first end 40 in a similar manner to that described above.

While one embodiment of the present invention has been described in the foregoing, it is to be understood that other embodiments are possible within the scope of the invention. The invention is to be considered limited solely by the scope of the appended claims.

What is claimed is:

1. A cutting mechanism for cutting a length of material from a supply of material, said cutting mechanism comprising:

an elongate member having a first end, a second end, an outer face for receiving the material thereon, and an inner face opposite the outer face;

a slot in the elongate member extending from the first end to the second end thereof;

a cutter block having a first end and a second end and movable along the slot between the first and second ends of the slot;

a guide member for guiding movement of the cutter block along the slot adjacent the inner face of the elongate member;

a knife blade mounted on the cutter block and extending through the slot for engaging the material on the outer face;

an elongate flexible drive member having a first end and a second end, said an elongate flexible drive member being fixed at each of its first and second ends to the cutter block;

and drive means for selectively moving the elongate flexible drive member in one of a first direction thereby causing movement the cutter block along the slot towards the first end of the slot, and a second direction thereby causing movement of the cutter block along the slot towards the second end of the slot, the drive means comprising:

a first pulley at a position spaced from the first end of the slot of the elongate member in the direction towards the second end of the slot of the elongate member and spaced from the inner surface of the elongate member and from the cutter block;

a second pulley at a position spaced from the second end of the slot of the elongate member in the direction towards the first end of the elongate member and spaced from the inner surface of the elongate member and from the cutter block;

and a drive element for driving one of the first and second pulleys in one of a first rotational direction and a second rotational direction;

wherein the elongate flexible drive member extends under and around each of the first and second pulleys, with the first end of the elongate flexible drive member extending around the first pulley to a first point on the cutter block, and the second end of the elongate flexible drive member extending around the second pulley to a second point on the cutter block;

wherein the first pulley is spaced from the inner face of the elongate member by a distance such that the cutter block, as it is guided by the guide member, passes at the first end of the slot between the first pulley and the inner face such that the first point on the cutter block is located at a position beyond the first pulley, at which position the first and second ends of the elongate flexible drive member are drawn taut such that movement of the cutter block along the slot is stopped by the taut elongate flexible drive member as the cutter block moves towards the first end of the slot;

and wherein the second pulley is spaced from the inner face of the elongate member by a distance such that the cutter block, as it is guided by the guide member, passes at the second end of the slot between the second pulley and the inner face such that the second point on the cutter block is located at a position beyond the second pulley, at which position the first and second ends of the elongate flexible drive member are drawn taut such that movement of the cutter block along the slot is stopped by the taut elongate flexible drive member as the cutter block moves towards the second end of the slot.

2. The cutting mechanism in accordance with claim 1 including a first idler pulley arranged to lie at a position adjacent the first pulley and between the first and second pulleys, and a second idler pulley arranged to lie at a position adjacent the second pulley and between the first and second pulleys, and wherein the elongate flexible drive member is arranged to extend over the first and second idler pulleys and then under and around each of the first and second pulleys.

3. The cutting mechanism in accordance with claim 1 wherein the knife blade includes a first end and a second end, said knife blade being arranged such that the first end lies adjacent the cutter block and extends through the slot to the second end, and wherein there is vided at least one pair of rollers rotatably mounted on the cutter block adjacent the second end of the knife blade, said rollers being arranged such that a first one of the at least one pair of rollers lies adjacent a first side of the knife blade, and a second one of the at least one pair of rollers lies adjacent a second side of the knife blade, and wherein the rollers are arranged adjacent the outer face of the elongate member to engage a portion of the material thereby holding the material in place against the outer face of the elongate member for cutting.

4. The cutting mechanism in accordance with claim 1 wherein the cutter block carries a central support member projecting through the slot to a position beyond the outer surface of the elongate member;

wherein there is provided a second knife blade;

wherein the support member carries the knife blade and a second knife blade with both knife blades lying in a common plane longitudinal of the cutter block, the knife blade having a sharpened edge facing toward the first end of the slot for acting on the material as the cutter block is moved toward said first end of the slot and the second knife blade having a sharpened edge facing toward the second end of the slot for acting on the material as the cutter block is moved toward said second end of the slot;

and wherein the support member carries a first pair of rollers associated with the knife blade and arranged on opposite sides of the knife blade and a second pair of rollers associated with the second knife blade and arranged on opposite sides of the second knife blade;

each pair of rollers having a common axle transverse to the direction of movement of the block with the axis of the first pair being arranged at a position spaced away from the outer surface of the elongate member generally aligned with the knife blade so as to press the material onto the outer surface as the knife blade acts to cut the material and the axle of the second pair being arranged at a position spaced away from the outer surface of the elongate member generally aligned with the second knife blade so as to press the material onto the outer surface as the second knife blade acts to cut the material.

5. The cutting mechanism in accordance with claim 4 wherein the central support member includes a central generally planar standard and a pair of arms connected to the standard each extending therefrom toward a respective one of the ends of the slot and each carrying a respective one of the pairs of rollers.

6. The cutting mechanism in accordance with claim 4 wherein the central support member defines a pair of slots each for receiving and mounting a respective one of the knife blades.

7. The cutting mechanism in accordance with claim 6 wherein the central support member carries a manually movable locking lever pivotal from a closed position dosing an open end of the slots to an open position allowing manual removal of the blades through the open end of the slots.

8. The cutting mechanism in accordance with claim 5 wherein the central support member defines a pair of slots each for receiving and mounting a respective one of the knife blades, each slot passing through a respective one of the pair of arms.

9. The cutting mechanism in accordance with claim 8 wherein the central support member carries a manually movable locking lever pivotally mounted at one end on one of the arms and movable from a closed position lying across a top of the arms and closing an open end of the slots to an open position allowing manual removal of the blades through the open end of the slots.

10. The cutting mechanism in accordance with claim 6 wherein the central support member includes a generally triangular section defining two sides inclined upwardly and toward a central apex and wherein each side defines a back support surface for a rear edge of a respective one of the knife blades.

11. The cutting mechanism in accordance with claim 6 including a spring biasing member biasing the central support toward the cutter block so as to bias the rollers onto the outer surface.

* * * * *